US005990790A

United States Patent [19]

Lusareta

[11] Patent Number: 5,990,790

[45] Date of Patent: Nov. 23, 1999

[54] INTERCHANGEABLE BASE FOR BEVERAGE CONTAINER HOLDER

[76] Inventor: Donald W. Lusareta, 10 Little J Cir., Russellville, Ark. 72802

[21] Appl. No.: 09/137,090

[22] Filed: Aug. 20, 1998

[51] Int. Cl.[6] ..... G08B 13/14

[52] U.S. Cl. ..... 340/571; 206/459.1; 220/903; 340/692; 340/693.5; 362/101

[58] Field of Search ..... 340/540, 571, 340/692, 665–6, 693.5; 206/459.1; 362/101; 220/739, 903

[56] References Cited

U.S. PATENT DOCUMENTS

| | | | |
|---|---|---|---|
| 4,336,574 | 6/1982 | Goodman | 362/101 |
| 4,344,113 | 8/1982 | Ditto et al. | 362/101 |
| 4,858,084 | 8/1989 | Sheryll | 362/101 |
| 4,886,183 | 12/1989 | Fleming | 362/101 X |
| 5,070,539 | 12/1991 | Cheng | 455/344 |
| 5,504,663 | 4/1996 | Tucker | 362/101 |
| 5,575,553 | 11/1996 | Tipton | 362/101 |

*Primary Examiner*—Thomas Mullen
*Attorney, Agent, or Firm*—John E. Vandigriff

[57] ABSTRACT

The invention is a base unit that may be used in combination with beverage container holders. The base unit is connected to the beverage container holder by a press or friction fit, or by an adhesive, so that different theme beverage container holders may be used with the same base. The base may include electronic circuitry to control such functions as sound, light and motion which may be actuated by a ON-OFF switch, or a switch that actuates when the base and beverage container holder are placed on, or lifted from a surface.

15 Claims, 5 Drawing Sheets

INTERCHANGEABLE BASE FOR BEVERAGE CONTAINER HOLDER

FIELD OF THE INVENTION

The invention relates to beverage container holders, and more specifically to a novel base unit, having electronic features, for use in combination with a beverage container holder.

BACKGROUND OF THE INVENTION

Beverage holders are made to hold and insulate can and bottle beverages so as to help the beverage stay cold longer, and to insulate a hand holding the beverage container from the cold and damp sides of the container. The container holder may be made of plastic, foam material, or rubber. The holder is usually in the shape of a cylinder into which the beverage container is inserted.

Many beverage holders are given away as novelty advertisement items and have logos and other drawings and advertisements on them.

U.S. Pat. No. 4,886,183, includes an insulated beverage holder in which message display lamps are embedded in the holder.

Other designs for containers may include circuitry to play music such as is described in U.S. Pat. No. 5,070,539.

Of the various designs for novelty containers and container holders described in the prior art, the novelty or advertisement part is on, or in the container holder, and is not adaptable for use with other containers or container holders.

SUMMARY OF THE INVENTION

The invention is a base unit that may be used in combination with beverage container holders. The base unit is connected to the beverage container holder by a press or friction fit, or may be glued with an adhesive or double-sided tape so that different theme beverage container holders may be used with the same base. The base may include electronic circuitry to control such functions as sound, light and motion which may be actuated by an ON-OFF switch, or a switch that actuates when the base and beverage container holder are lifted from, or placed on a surface. The consumer or manufacturer may change the beverage holder attached to the base, or it may be fixed in place.

DESCRIPTION OF A PREFERRED EMBODIMENT

Figure 1:
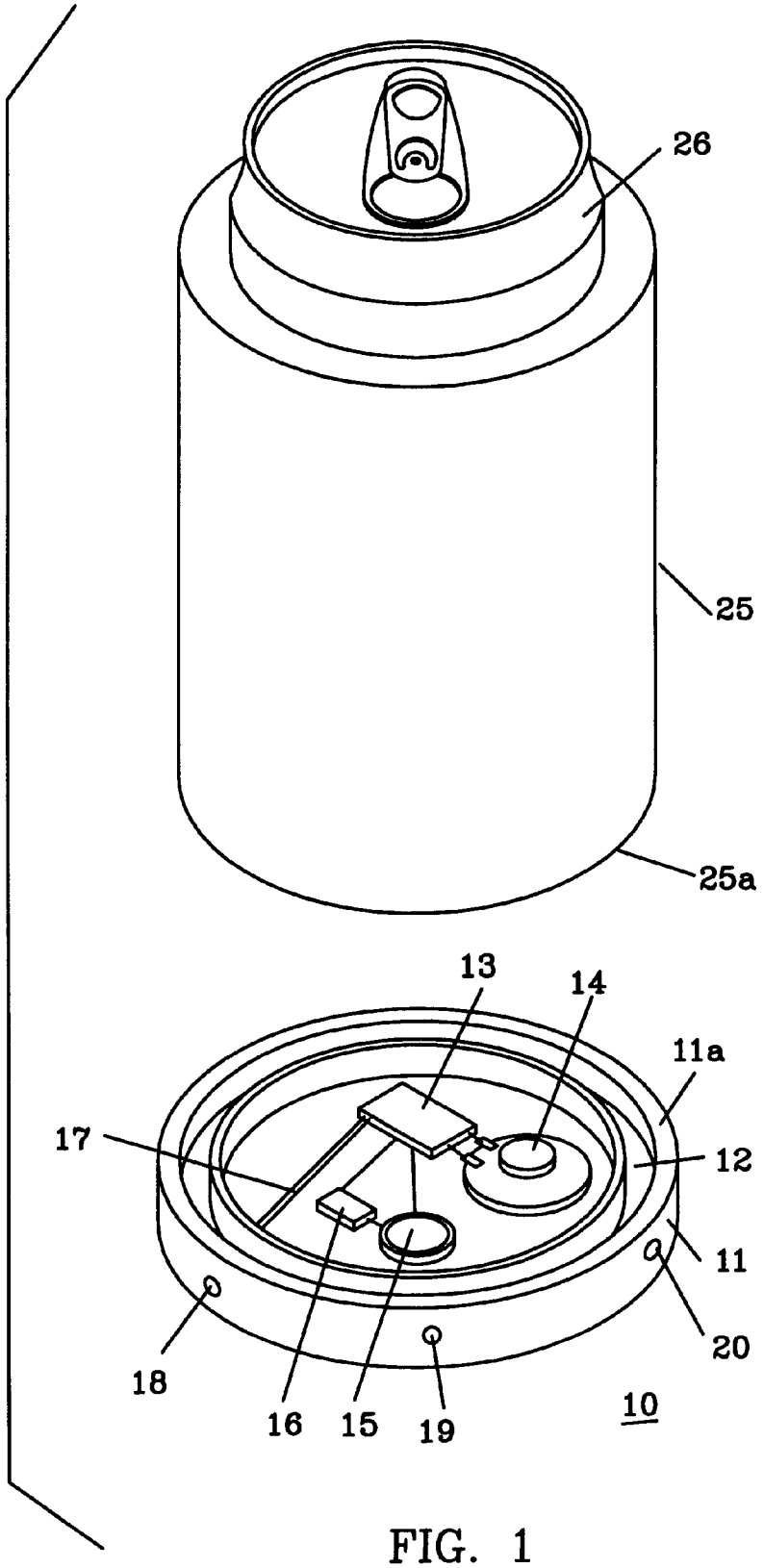
FIG. 1 shows a base unit of the present invention used with a container holder.

FIG. 1 shows a base unit 10 of the present invention which is used in conjunction with a beverage holder, for example the beverage holder 25. Beverage holder 25 has a beverage can 26 inserted into the holder. Base unit 10 is constructed to be used with various beverage holders and has a channel 12 just inside the outer rim 11*a* of base 10. The bottom end 25*a* of holder 25 is inserted into channel 12 and is held there by friction, glue, or any other desirable means. Holder 25 is usually made of a plastic, foam, or rubber material so that it insulates the beverage container and can be pushed into channel 12 and withdrawn as necessary.

Base 10 includes electronic circuitry, for example, a electronic unit 13 which may include several controlling functions including blinking of lights, sound, or motion, such as vibrations. Electronic unit 13 may be, for example, one of several products manufactured by Integrated Silicon Solution, Inc., whose products include control devices which may be used in conjunction with generating sound, lights and motion.

Shown in base 10 is the control unit 13 connected to a speaker or sound piezo element 14, switch 16 and battery 15. Shown are three light sources 18, 19 and 20 around the edge of base 10, extending through wall 11. LEDs may extend through the bottom of the base also (not illustrated). Control unit may, for example, play a music clip or enunciate a phrase or word through speaker 14. Control unit 13 may cause lights 18–20 to blink randomly or in a programmed sequence. Switch 16 is used to turn power on and off to the control unit 13 from battery 15. Switch 16 may be a simple ON and off switch, or may be a switch that supplies power only when a base, in conjunction with a beverage holder is picked up off a table and held in the hand, or placed upon a surface.

There may be two switches, one to apply power and another to power various functions when the holder and base are placed on or removed from a surface. In this instance the power switch 16 would serve as the ON-OFF switch and switch 70 (FIG. 6), for example, would be a normally ON or normally OFF, depending upon its use, power on when the base is on a surface, or normally OFF when the base is not on a surface.

Figure 2:
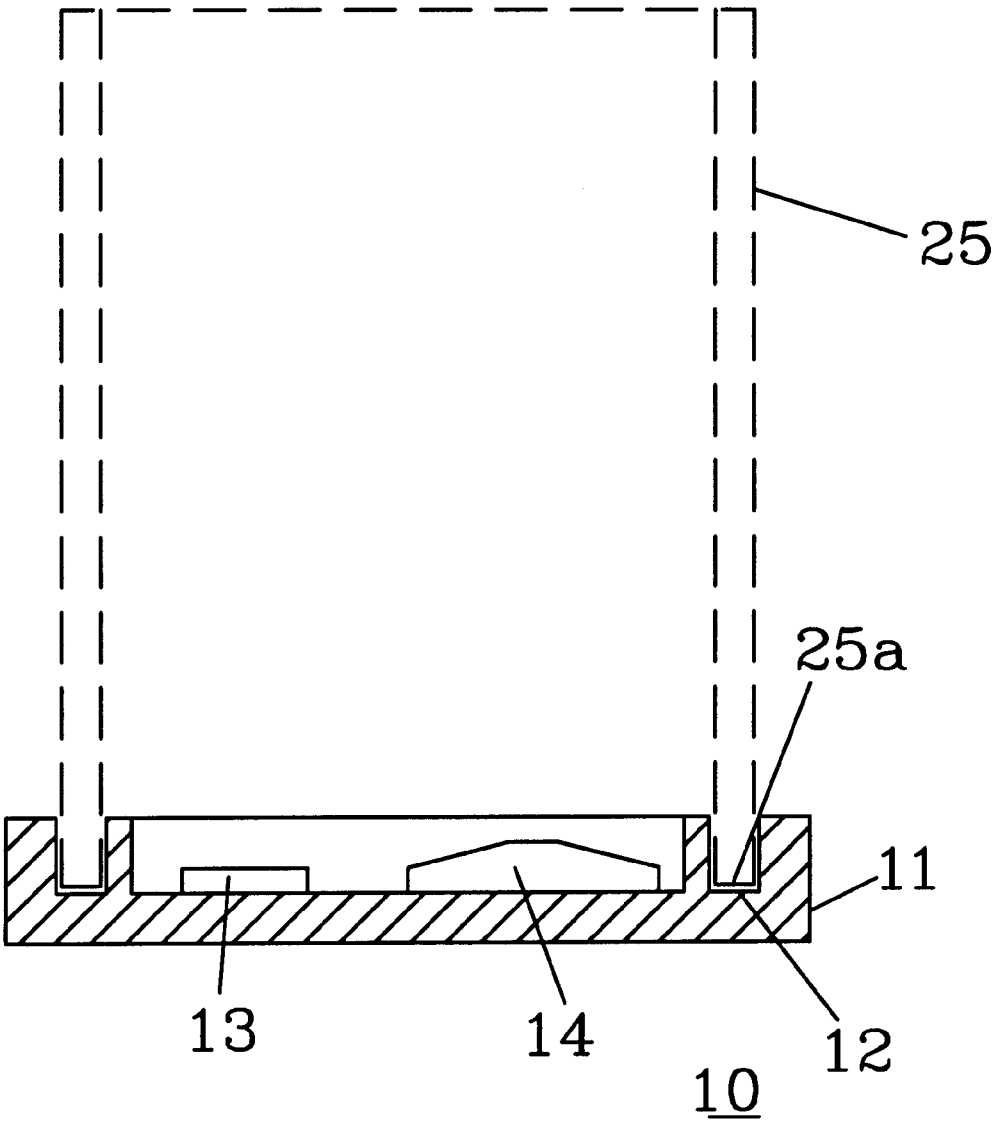
FIG. 2 is a cross-sectional view of a base unit, and a container in outline.

FIG. 2 is a cross sectional view of base 10 showing channel 12 into which end 25*a* is inserted to secure holder 25 to base 10. Speaker 14 and control unit 13 are also shown. Beverage holder 25 is shown in dashed lines to distinguish its structural features from base 10.

Figure 3:
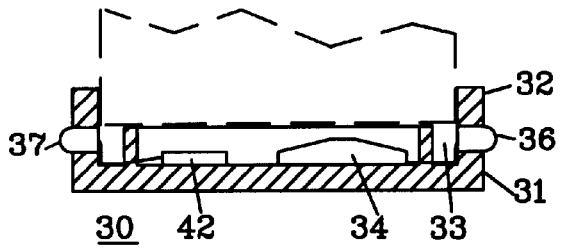
FIG. 3 is a cross-sectional view of a modified base unit.

FIG. 3 is a modified base 30 in which the side 31 has been extended upward at 32 for accommodating beverage holders which have a solid or enclosed bottom. A partial view of the beverage holder is shown in dashed lines to show its position in base 30. As in the configuration of FIG. 2, base 30 and beverage holder 25 may be held together by frictional contact, or some type of adhesive. The base 30 includes a channel 33 which corresponds to the channel 12 in FIG. 1.

Figure 4:
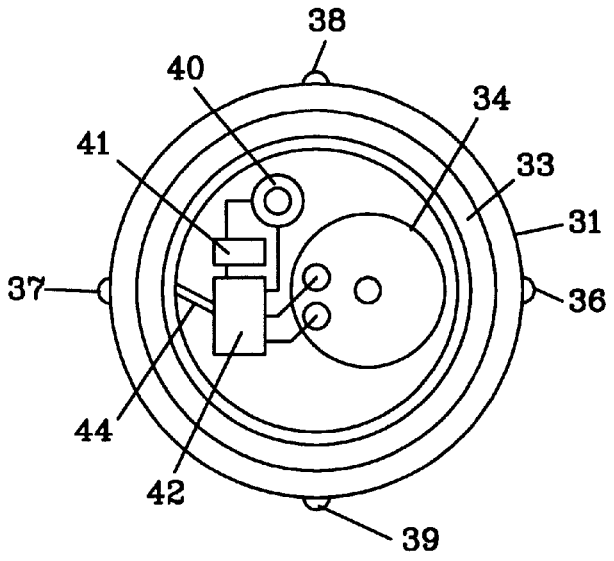
FIG. 4 is a top view of the modified base unit.

The control unit 42, and speaker 34, are shown mounted in the central portion of base 30. A top view of base 30 is shown in FIG. 4 in which the circuit, which includes speaker 34, control unit 42, switch 41 and battery 40 are shown connected together. Lights 36–39 are shown extending out wall 31, and connected to control unit 42 by wires 44.

Figure 5:
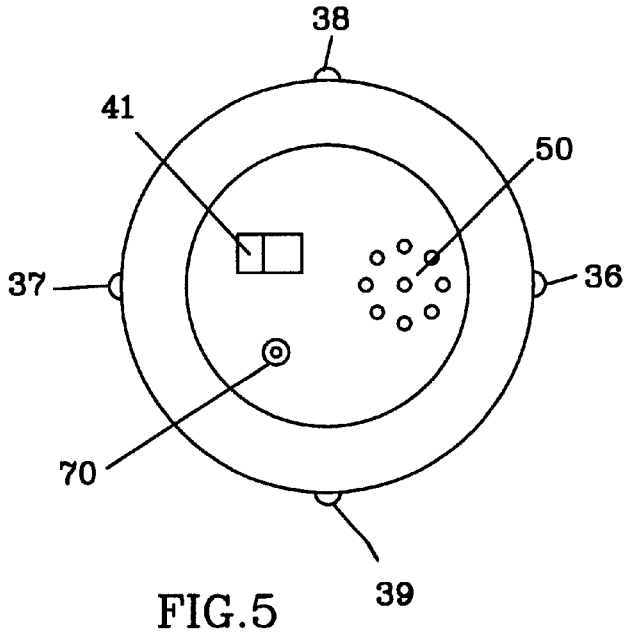
FIG. 5 is a bottom view of the base unit.

FIG. 5 is a bottom view of base 30 showing switch 41 extending out the bottom of unit 30. Switch 41 may be a simple ON-OFF switch or may be a switch normally in the ON position except when the base is placed on a surface, at which time the switch is OFF. When switch 41 is used as an ON/OFF switch only, then a second switch 70 is added to activate a function. Openings 50 serve as openings for speaker 34 through base 30.

Figure 6:
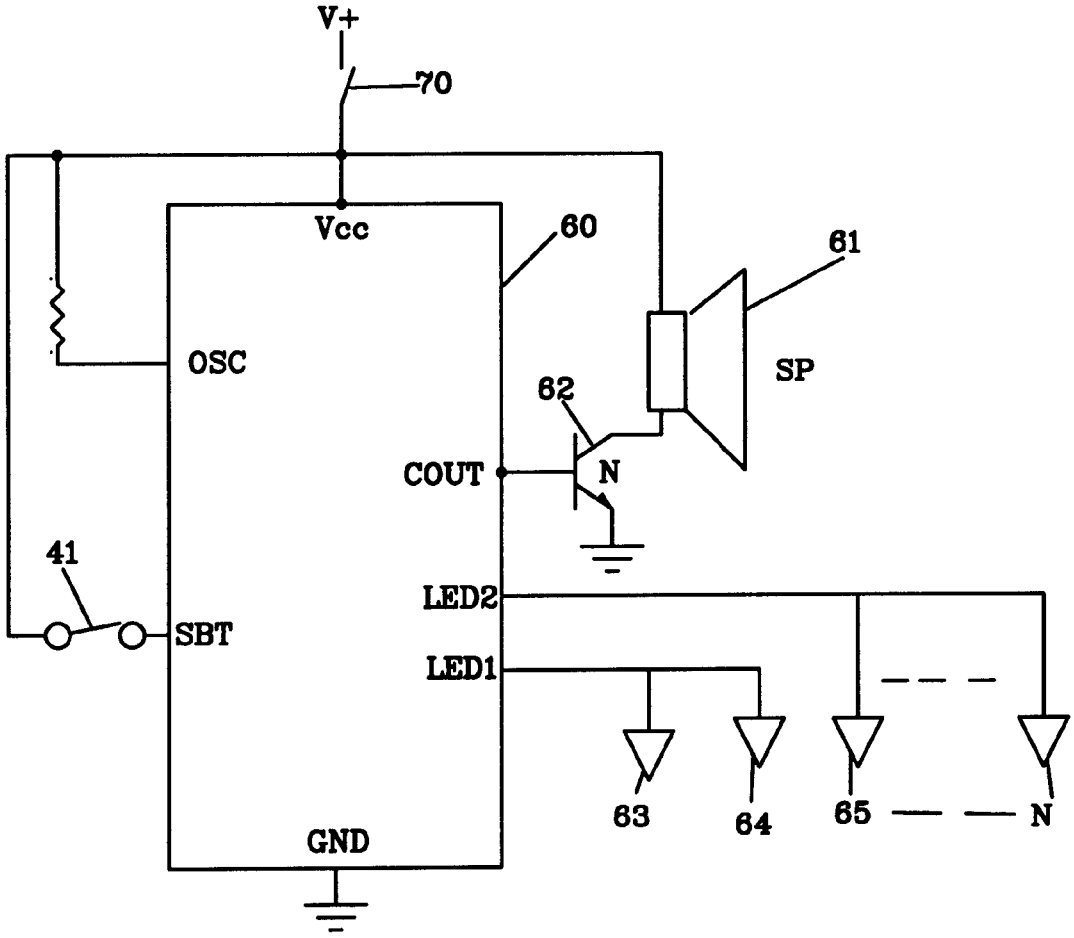
FIG. 6 shows an example of a circuit that can be used with the base unit.

FIG. 6 shows an example of a circuit utilizing a control unit 60 connected to a speaker through an amplifier 62, and a plurality of light emitting diodes 63-N. Control unit has an output connection COUT which is connected to amplifier 62, which provides an audio output to speaker 61. Light emitting diodes 63-N are connected to outputs LED1–LED2 to provide power to illuminate the two or more LEDs 63-N.

Figure 7:
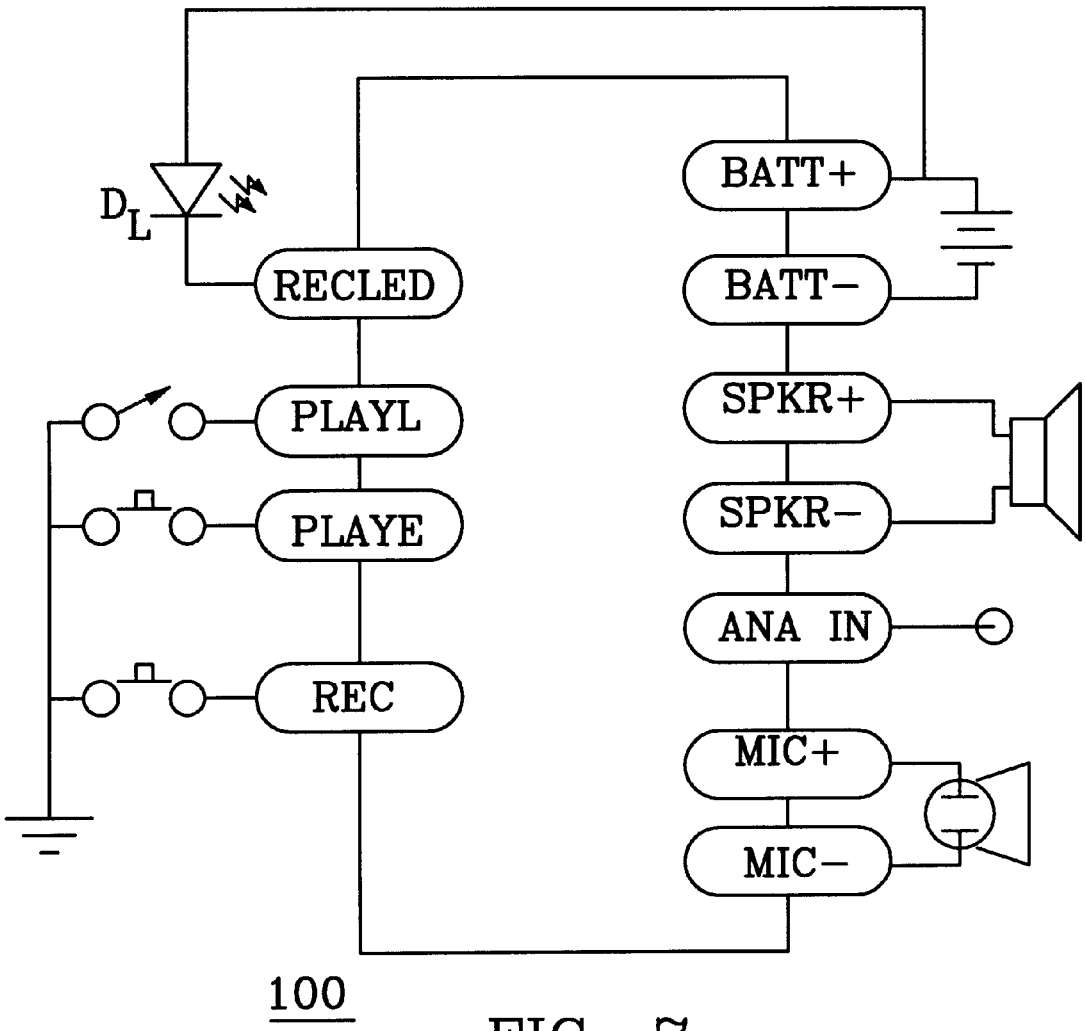
FIG. 7 shows an example of a circuit with a message record/playback circuit.

FIG. 7 shows a device 100 that can be used with the base 10 to record and playback messages. The device can be, for example, a Radio shack VM-110A device. There are two battery connections BATT+ and BATT− which connect to, for example, a 4.5 to 5.5 V DC power supply. Output is through speaker connections SPKR+ and SPKR−. These outputs provide direct drive for speakers with impedances as low as 16 ohms. The connections MIC+ and MIC-connect a microphone to the device.

When the input signal goes from HIGH to LOW, playback starts. Play continues until either PLAYL is pulled high, and end of message marker is reached, or the end of the recording space is reached. When a LOW going transition occurs on the PLAYE input, playback begins and continues until the end-of-message or end-of-device space marker occurs. Taking PLAYE HIGH during playback does not stop playback.

The RECLED signal is LOW during recording. It can directly drive an LED. This output also pulses LOW when an end-of-message marker is encountered.

The device records when REC is LOW. The signal must remain LOW for the duration of the recording.

ANA_IN is an alternative input source with a maximum 50 mV peak-to-peak limit. ANA_IN is left floating if unused.

The base unit described above may be used in combination with most beverage holders so that it may be used as a common base for different beverage holders having different designs and advertisements thereon. One base unit may be purchased and used with different beverage holders having different themes for various occasions. Alternatively, the manufacturer may attach a base to a holder before selling the holder.

What is claimed:

1. A base unit for use with a beverage container holder comprising:

a base and a beverage container holder mounted thereon;

a recess in said base for receiving the beverage container holder; and an electronic circuit within said base, including a first switch, for producing at least one of sound, light and motion when the base unit is at least one of placed upon and removed from a surface thereby causing the switch to change state.

2. The base unit according to claim 1, including a second switch connected to said electronic circuit for applying and removing power to said electronic circuit.

3. The base unit according to claim 1, wherein said first switch is a normally ON switch, and is turned OFF when the base unit is placed on a surface.

4. The base unit according to claim 1, wherein said first switch is a normally OFF switch, and is turned ON when the base unit is removed from a surface.

5. The base unit according to claim 1, including a speaker mounted in the base that directs sounds produced by the speaker through openings in said base.

6. The base unit according to claim 1, wherein said recess in said base is a circular channel for receiving one end of a cylindrical beverage holder.

7. The base unit according to claim 1, wherein said recess is a circular opening for receiving a closed end of a beverage container.

8. A base unit for use in combination with a beverage container holder, comprising:

a beverage container holder;

a base unit;

a recess in said base unit for receiving and holding the beverage container holder; and an electronic circuit within said base, including a first switch, for producing at least one of sound, light and motion when the base unit is at least one of placed upon and removed from a surface thereby causing the switch to change state.

9. The base unit according to claim 8, including a second switch connected to said electronic circuit for applying and removing power to said electronic circuit.

10. The base unit according to claim 8, wherein said first switch is a normally ON switch, and is turned off when the base unit is placed on a surface.

11. The base unit according to claim 8, wherein said first switch is a normally OFF switch, and is turned ON when the base unit removed from a surface.

12. The base unit according to claim 8, including a speaker mounted in the base that directs sounds produced by the speaker through openings in said base.

13. The base unit according to claim 8, wherein said recess in said base is a circular channel for receiving one end of a cylindrical beverage holder.

14. The base unit according to claim 8, wherein said recess is a circular opening for receiving a closed end of a beverage container.

15. A base unit for use in combination with a beverage container holder, comprising:

a beverage container holder;

a base unit;

a recess in said base unit for receiving and holding the beverage container holder; and an electronic circuit within said base, including a first switch, for producing at least one of sound, light, motion and a recorded message when the base unit is at least one of placed upon and removed from a surface thereby causing the switch to change state.

* * * * *